US010454220B2

(12) United States Patent
Sakaizawa

(10) Patent No.: US 10,454,220 B2
(45) Date of Patent: Oct. 22, 2019

(54) CONNECTOR

(71) Applicant: HIROSE ELECTRIC CO., LTD., Tokyo (JP)

(72) Inventor: Tadashi Sakaizawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/062,792

(22) PCT Filed: Nov. 10, 2016

(86) PCT No.: PCT/JP2016/083332
§ 371 (c)(1),
(2) Date: Jun. 15, 2018

(87) PCT Pub. No.: WO2017/104312
PCT Pub. Date: Jun. 22, 2017

(65) Prior Publication Data

US 2018/0358755 A1 Dec. 13, 2018

(30) Foreign Application Priority Data

Dec. 18, 2015 (JP) ..... 2015-246890

(51) Int. Cl.
*H01R 13/6582* (2011.01)
*H01R 13/6587* (2011.01)
(Continued)

(52) U.S. Cl.
CPC ..... *H01R 13/6582* (2013.01); *H01R 12/716* (2013.01); *H01R 13/6273* (2013.01);
(Continued)

(58) Field of Classification Search
CPC ..... H01R 13/6273; H01R 13/639; H01R 13/6275; H01R 13/6581–6583;
(Continued)

(56) References Cited

U.S. PATENT DOCUMENTS 5,975,957 A 11/1999 Noda et al.
8,083,535 B2 * 12/2011 Chang ..... H01R 13/6397 439/357
(Continued)

FOREIGN PATENT DOCUMENTS

CN 1202749 A 12/1998
CN 2814714 Y 9/2006
(Continued)

OTHER PUBLICATIONS

International Search Report dated Feb. 14, 2017 filed in PCT/JP2016/083332.
(Continued)

*Primary Examiner* — James Harvey
*Assistant Examiner* — Oscar C Jimenez
(74) *Attorney, Agent, or Firm* — Rankin, Hill & Clark LLP

(57) ABSTRACT

In a typical connector, without closing up a clearance between connectors sufficiently upon fitting with a partner connector, a problem such as significant lowering of high-frequency characteristics due to backlash is caused upon high-speed electric signal transfer. A connector is provided, which includes multiple terminals, an insulator holding the multiple terminals, and an outer conductor shell housing the insulator. In the connector, an inclined portion raised from a side wall of the outer conductor shell is provided at a side wall portion which is to contact an edge portion of a fitting recessed portion of a partner connector. Thus, when a fitting portion on a tip end side of the outer conductor shell of the connector is fitted in the fitting recessed portion of the partner connector, an edge portion of an opening of the fitting recessed portion of the partner connector is pressed by the inclined portion provided at the side wall of the fitting portion of the connector, and a side wall of a lock protrusion is pressed against an inner wall of a lock hole. Thus, the clearance can be suppressed.

13 Claims, 5 Drawing Sheets

(51) Int. Cl.

| | |
|---|---|
| ***H01R 12/71*** | (2011.01) |
| ***H01R 13/639*** | (2006.01) |
| ***H01R 13/627*** | (2006.01) |
| ***H01R 24/60*** | (2011.01) |
| ***H01R 13/6594*** | (2011.01) |

(52) U.S. Cl.
CPC ..... *H01R 13/639* (2013.01); *H01R 13/6587* (2013.01); *H01R 13/6594* (2013.01); *H01R 24/60* (2013.01)

(58) Field of Classification Search
CPC ..... H01R 13/6587; H01R 13/6594; H01R 2107/00; H01R 12/724; H01R 12/74; H01R 12/716; H01R 24/60
See application file for complete search history.

(56) References Cited

U.S. PATENT DOCUMENTS

| | | | | |
|---|---|---|---|---|
| 8,152,566 | B1 * | 4/2012 | Little | H01R 13/6582 439/607.41 |
| 8,668,524 | B2 * | 3/2014 | Lan | H01R 12/724 439/607.35 |
| 2003/0157836 | A1 * | 8/2003 | Morikawa | H01R 13/6275 439/607.41 |
| 2008/0166905 | A1 | 7/2008 | Murphy et al. | |
| 2010/0267262 | A1 * | 10/2010 | Lin | H01R 27/00 439/218 |
| 2011/0268396 | A1 * | 11/2011 | He | G02B 6/3817 385/93 |
| 2012/0252255 | A1 * | 10/2012 | Colantuono | H01R 13/6275 439/353 |
| 2014/0322976 | A1 * | 10/2014 | Raschilla | H01R 13/648 439/607.55 |
| 2015/0255931 | A1 * | 9/2015 | Yen | H01R 13/6582 439/620.21 |
| 2018/0212360 | A1 * | 7/2018 | Motohashi | H01R 13/447 |

FOREIGN PATENT DOCUMENTS

| | | | |
|---|---|---|---|
| DE | 202013103103 | U1 | 8/2013 |
| EP | 0874419 | A1 | 10/1998 |
| EP | 1028496 | A2 | 8/2000 |
| JP | 2004134148 | A | 4/2004 |
| JP | 2013109971 | A | 6/2013 |
| JP | 5406746 | B2 | 2/2014 |
| JP | 2015138719 | A | 7/2015 |
| WO | 2015020125 | A1 | 2/2015 |

OTHER PUBLICATIONS

Office Action dated Apr. 26, 2019 for the corresponding Chinese Patent Application No. 201680066901.8; machine translation.
Extended European Search Report (EESR) issued on Jul. 10, 2019 for the corresponding European Patent Application No. 16875296.2.

* cited by examiner

CONNECTOR

TECHNICAL FIELD

The present invention relates to a connector suitable for high-speed electric signal transfer. Specifically, the present invention relates to the structure of a fitting portion of a connector configured to suppress backlash at the fitting portion upon connection with a partner connector.

BACKGROUND ART

Typically, a connector is configured such that a slight clearance is, for facilitating attachment/detachment to/from a partner connector, formed with the connector being connected to the partner connector. In the typical connector, an elastic member such as a spring is provided to close up the clearance to suppress backlash due to such a clearance. For example, in a connector described in Japanese Patent No. 5406746 (Patent Literature 1), a clearance (an engagement clearance) between a connector lock portion and a connector engagement portion can be closed up by a spring piece provided at a back wall of a fitting recessed portion.

CITATION LIST

Patent Literature

PATENT LITERATURE 1: Japanese Patent No. 5406746

SUMMARY OF THE INVENTION

Problems to be Solved by the Invention

However, in a relatively-small high-speed transfer connector including an insulator configured to hold multiple terminals and an outer conductor shell housing the insulator, a spring piece provided at a back wall of a fitting recessed portion as in the connector described in Japanese Patent No. 5406746 (Patent Literature 1) leads to a problem that a connector structure is complicated. Moreover, without closing up a clearance between connectors sufficiently upon fitting with a partner connector, a problem such as significant lowering of high-frequency characteristics due to backlash upon high-speed electric signal transfer might be caused.

For solving the above-described problems, a connector is provided, which includes multiple terminals, an insulator holding the multiple terminals, and an outer conductor shell housing the insulator. In the connector, an inclined portion raised from a side wall of the outer conductor shell is provided at a side wall portion which is to contact part (e.g., an edge portion) of a fitting recessed portion of a partner connector. Thus, when a fitting portion on a tip end side of the outer conductor shell of the connector is fitted in the fitting recessed portion of the partner connector, backlash can be suppressed. Specifically, the connector is provided in which part (e.g., an edge portion) of an opening of the fitting recessed portion of the partner connector is pressed by the inclined portion provided at the side wall of the fitting portion of the connector, and a side wall of a lock protrusion is pressed against an inner wall of a lock hole. Thus, a clearance (an engagement clearance) which might be formed upon engagement of the lock protrusion of the connector with the lock hole of the partner connector can be closed up.

Solution to the Problems

A connector according to one embodiment of the present invention is a cable-side connector including an outer conductor shell and an insulator housed in the outer conductor shell with the insulator holding multiple terminals.

The outer conductor shell includes

- an inclined portion exhibiting elasticity in such an inclined shape that a side wall is raised,
- an engagement portion to be engaged with a partner engagement portion of a partner connector, and
- a fitting portion to be fitted in a fitting recessed portion of the partner connector.

The inclined portion is provided at the side wall of the outer conductor shell which is to contact part of the fitting recessed portion of the partner connector.

When the inclined portion contacts the part of the fitting recessed portion, the engagement portion closely contacts the partner engagement portion with no clearance.

In a preferred embodiment of the connector according to the present invention, the inclined portion is provided at a single side wall of the outer conductor shell, and is also provided at a side wall opposite to the side wall.

In a preferred embodiment of the connector according to the present invention, the inclined portion is provided on a plane same as that of a side wall provided with the engagement portion.

In a preferred embodiment of the connector according to the present invention, the inclined portion is provided on a plane different from that of the side wall provided with the engagement portion.

In a preferred embodiment of the connector according to the present invention, the connector further includes

- a cover member configured to cover a connection portion between the outer conductor shell and a cable, the fitting portion being exposed from a tip end side of the connector; and
- a lock operation button coupled to the engagement portion and exposed through a hole provided at the cover member.

The engagement portion is pushed inward of the outer conductor shell in association with pushing in of the lock operation button.

A partner connector according to one embodiment of the present invention includes

- an outer conductor shell having a partner engagement portion at a position engageable with the engagement portion of the connector, and
- an insulator housed in the outer conductor shell.

The outer conductor shell of the partner connector includes a fitting recessed portion to be fitted onto the fitting portion of the connector.

Upon connection with the connector, part of the fitting recessed portion contacts the inclined portion of the connector.

In a preferred embodiment of the partner connector according to the present invention, the partner engagement portion of the partner connector engages, upon connection with the connector, with the engagement portion of the connector, and part of the fitting recessed portion of the partner connector contacts the inclined portion of the connector and is pushed by elastic force of the inclined portion such that no clearance is formed between the partner engagement portion and the engagement portion.

In a preferred embodiment of the partner connector according to the present invention, a part of the fitting recessed portion which is to contact the inclined portion is an edge portion of the fitting recessed portion, and an inclined edge portion extending from the edge portion and inclined outward is provided.

Advantageous Effects of the Invention

In the connector according to the present invention, the inclined portion raised from the side wall of the fitting portion included on the tip end side of the outer conductor shell is provided at the side wall portion of the fitting portion which is to contact the edge portion of the fitting recessed portion of the partner connector. Thus, upon connection with the partner connector, the edge portion of the fitting recessed portion is pressed by the elastic force of the inclined portion provided at the side wall of the fitting portion, and an engagement clearance which might be formed between the lock protrusion of the connector and the lock hole of the partner connector is closed up. Thus, backlash can be suppressed.

Moreover, the connector and the partner connector according to the present invention are not configured such that a spring piece is provided at a back wall of the fitting recessed portion as in the typical connector, but is configured such that the inclined portion raised from the side wall of the outer conductor shell is merely provided at the position contacting the edge portion of the fitting recessed portion of the partner connector. Thus, a simpler structure as compared to that of the typical connector can be employed.

DESCRIPTION OF THE EMBODIMENTS

Figure 1:
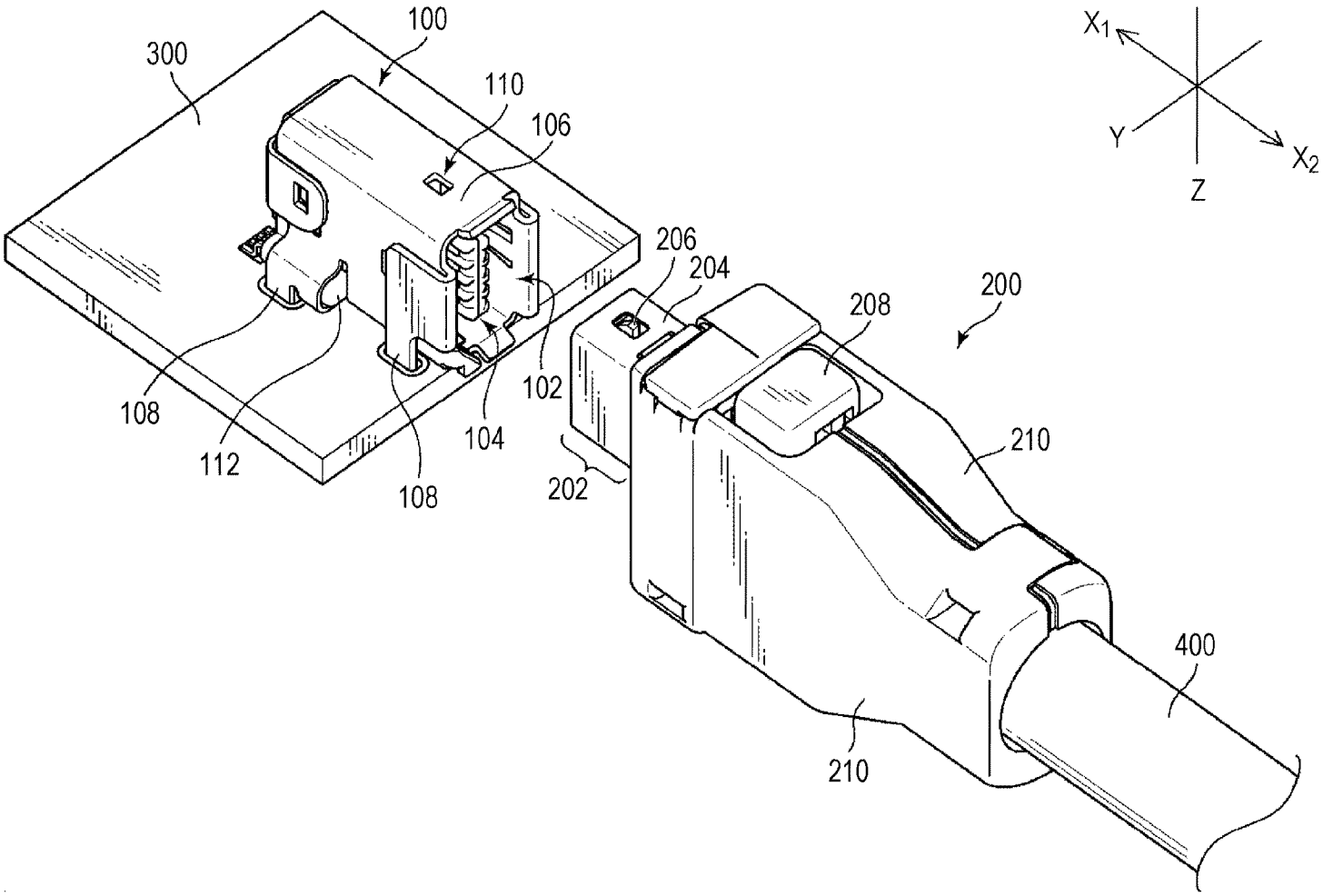
FIG. 1 illustrates a view of outer appearances of a substrate-side connector and a cable-side connector.

Hereinafter, embodiments of the present invention will be described with reference to the drawings. Note that in all figures for describing the embodiments, the same reference numerals are, as a general rule, used to represent the same members, and therefore, repeated description thereof will not be made. Moreover, each embodiment will be independently described, but it does not intended to exclude a combination of components of these embodiments forming a connector.

FIG. 1 illustrates a view of outer appearances of a substrate-side connector and a cable-side connector. A connector fitting direction is an X1-X2 direction (an X-axis direction) in the figure. A tip end side of the substrate-side connector 100 is an X2 direction side, and a tip end side of the cable-side connector 200 is an X1 direction side. A plane perpendicular to a substrate 300 is an X-Z plane, and a plane horizontal (a plane parallel) to the substrate 300 is an X-Y plane. Upper and lower sides along a Z-axis direction in the figure are upper and lower sides of each connector. The same also applies to other figures.

The substrate-side connector 100 includes an insulator 112 configured to hold multiple terminals forming a fitting raised portion 104 on a side (the X2 direction side) to be connected to the cable-side connector 200, and an outer conductor shell 106 housing the insulator 112 therein. A fitting recessed portion 102 is a space between the fitting raised portion 104 provided on a fitting side (the X2 side) of the outer conductor shell 106 and an inner wall of the outer conductor shell 106. The outer conductor shell 106 includes shell mounting portions 108 for mounting and fixing the outer conductor shell 106 onto the substrate 300. The shell mounting portions 108 are DIP terminals soldered with the DIP terminals being inserted into holes provided at the substrate 300, but may be terminals mountable on a substrate surface.

Moreover, the outer conductor shell 106 includes lock holes 110 as partner engagement portions to be engaged with lock protrusions 206 as engagement portions of the cable-side connector 200. The lock holes 110 are provided at such positions that the lock holes 110 can engage with the lock protrusions 206 of the cable-side connector 200. In FIG. 1, the lock holes 110 are provided at upper and lower (the upper and lower sides in the Z-axis direction) side walls of the outer conductor shell 106 of the connector 100. As long as the lock holes 110 are the engagement portions having such structure that the lock holes 110 can engage with the lock protrusions 26, the lock holes 110 are not necessarily holes penetrating the outer conductor shell.

The cable-side connector 200 includes an outer conductor shell 200 having a fitting portion 204 on a side (the X1 direction side) to be connected to the substrate-side connector 100, i.e., on the tip end side, and housing an insulator, therein, configured to hold the multiple terminals, a lock operation button 208 cooperating with the lock protrusions 206 protruding from holes of the outer conductor shell 204, and a cover member 210 covering a connection portion between the outer conductor shell 204 and a cable 400.

The fitting portion 202 is inserted into the fitting recessed portion 102 upon connection with the substrate-side connector 100. The outer conductor shell 204 has, at side walls thereof, the holes 218 allowing the lock protrusions 206 to protrude from the inside. The lock protrusions 206 as the engagement portions are provided at such positions that the lock protrusions 206 can engage with the lock holes 110 as the partner engagement portions of the substrate-side connector 100. In FIG. 1, the lock protrusions 206 are provided at upper and lower (the upper and lower sides in the Z-axis direction) side walls of the outer conductor shell 204 of the connector 200. For the lock protrusions 206, any structure may be employed as long as the lock protrusions 206 are engagement portions engageable with the lock holes 110.

The lock protrusions 206 are, inside the outer conductor shell 204, coupled to the lock operation button 208, and are pushed in in association with pushing in of the lock operation button 208. The lock operation button 208 is pushed in upon connection with the substrate-side connector 100 such that the lock protrusions 206 disengage from the lock holes 110, and the cable-side connector 200 can be pulled out of the substrate-side connector 100.

Figure 2:
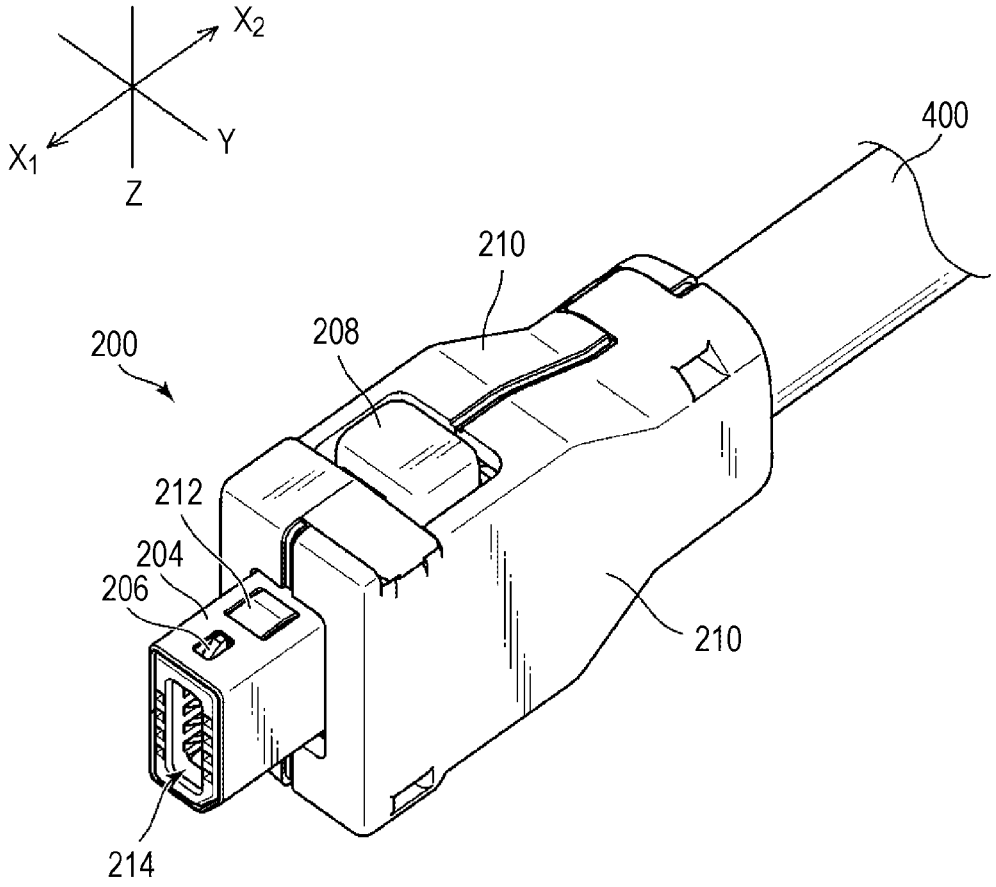
FIG. 2 illustrates a view of the outer appearance of the connector according to one embodiment of the present invention.

FIG. 2 illustrates a view of the cable-side connector according to one embodiment of the present invention, FIG. 2 being a perspective view of the cable-side connector 200 viewed diagonally from a side (the X1 side) to be fitted in the connector 100 as a partner connector. The outer conductor shell 204 of the connector 200 includes an inclined portion 212 at a side wall (an upper surface in FIG. 2) of the fitting portion 202 (see FIG. 1). The inclined portion 212 is formed with elasticity in such a manner that the side wall of the outer conductor shell 204 (the fitting portion 202 (see FIG. 1)) is raised. The inclined portion 212 is provided at the side wall of the outer conductor shell 204 which is to contact part (an edge portion in the present embodiment) of the fitting recessed portion 102 of the partner connector (the connector 100). As long as part of the fitting recessed portion 102 is to contact the inclined portion 212, the position of the inclined portion 212 may be any position at the outer conductor shell 204.

At the tip end of the cable-side connector 200, an insertion port 214 is provided with an inner wall holding the multiple terminals by the insulator. The insertion port 214 can receive the fitting raised portion 104 of the partner connector (the connector 100). Upon connection with the partner connector, contact portions of the multiple terminals held at the inner wall of the insertion port 214 come into contact with contact portions of the multiple terminals held by the insulator forming the fitting raised portion 104.

The lock protrusions 206 as the engagement portions are configured such that the lock protrusions 206 are pushed inward of the outer conductor shell 204 in association with pushing in of the lock operation button 208. As long as the lock protrusions 206 are configured to be disengaged from the partner engagement portions of the partner connector by the lock operation button 208, the lock protrusions 206 may have other configurations than the embodiment illustrated in FIGS. 1 to 2.

Figure 3:
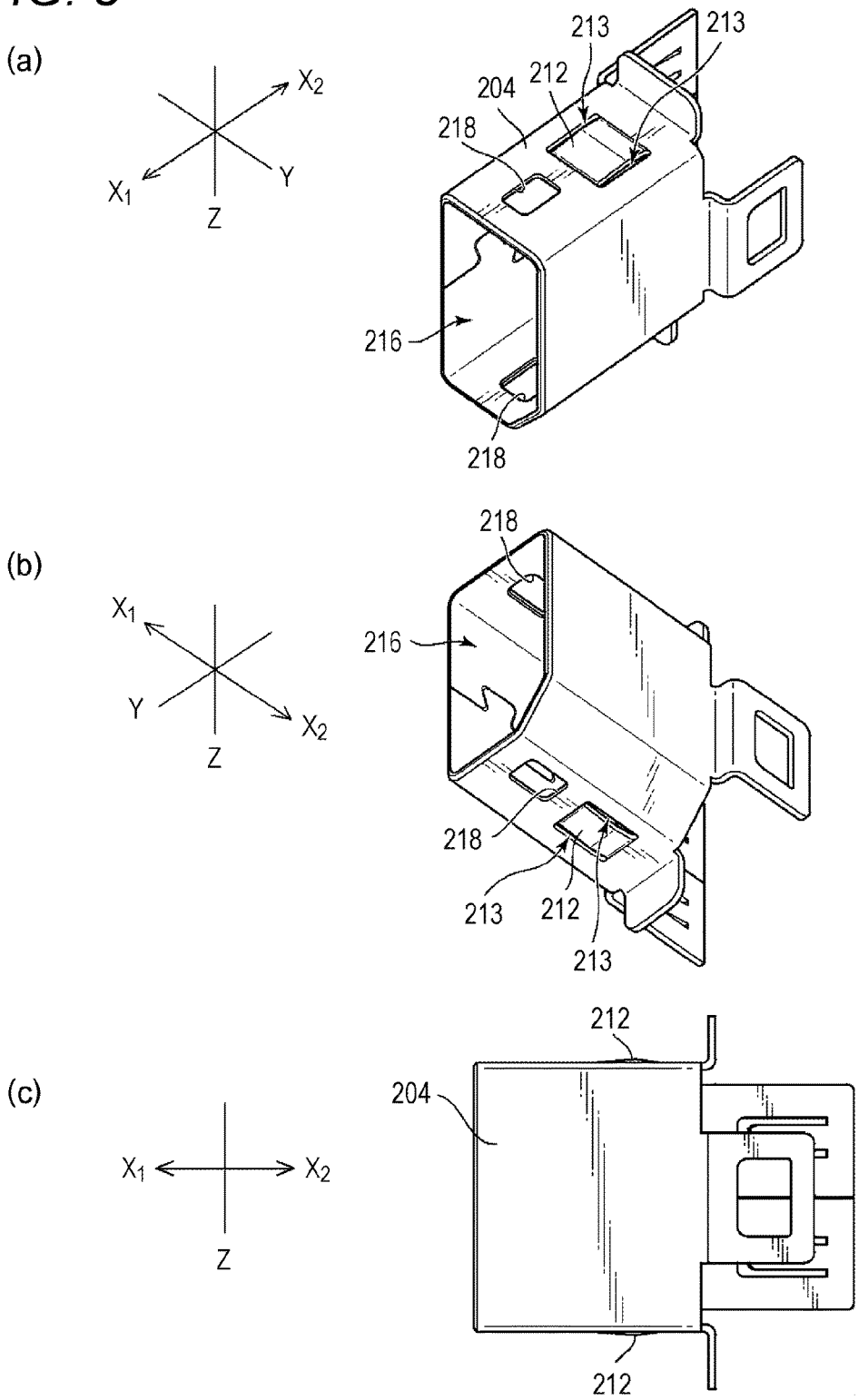
FIG. 3 illustrates views of components of an outer conductor shell forming a fitting portion on a tip end side of the cable-side connector.

FIG. 3 illustrates components of the outer conductor shell forming the fitting portion on the tip end side of the cable-side connector. FIG. 3(*a*) is a perspective view of the outer conductor shell 204 viewed diagonally from above on the tip end side (the X1 side) of the connector, FIG. 3(*b*) is a perspective view of the outer conductor shell 204 viewed diagonally from below on the tip end side (the X1 side) of the connector, and FIG. 3(*c*) is a side view of the outer conductor shell 204 viewed from a lateral direction (a Y-axis direction) of the connector.

A shell opening 216 is included on the tip end side (the X1 side) of the outer conductor shell 204, and the insulator forming the insertion port 214 (see FIG. 2) with the insulator holding the multiple terminals is housed inside the shell opening 216. As illustrated in FIGS. 3(*a*) and 3(*b*), the through-holes 218 allowing the lock protrusions 206 to protrude out of the outer conductor shell 204 are provided at the upper and lower (the upper and lower sides in the Z-axis direction) side walls of the outer conductor shell 204. The through-holes 218 can be provided according to the positions of the lock protrusions 206 arranged to engage with the lock holes 110 as the engagement portions of the partner connector (the connector 100). Moreover, the through-hole 218 is provided together with the lock protrusion 206 at a single side wall of the outer conductor shell 204, and the through-hole 218 and the lock protrusion 206 can be also provided at the side wall opposite to the single side wall.

As illustrated in FIGS. 3(*a*) and 3(*b*), the inclined portion 212 is provided at a single side wall of the outer conductor shell 204, and can be also provided at the side wall opposite to the side wall. The inclined portion 212 is, at the upper and lower (the upper and lower in the Z-axis direction) side walls of the outer conductor shell 204, formed in such a manner that two slits 213 extending in the fitting direction (the X-direction) are provided and the side wall is raised from the inside of the outer conductor shell 204. With this configuration, the inclined portion 212 has elasticity. Referring to FIGS. 2 and 3, the inclined portion 212 is provided at a back (X2 side) position of the position of the through-hole 218 and a front (X1 side) position of the cover member 210 in one embodiment of the present invention. The present invention is not limited to this embodiment. The inclined portion 212 may be at any position as long as the inclined portion 212 can contact part of the fitting recessed portion of the partner connector. At the side wall of the outer conductor shell, the inclined portion 212 may be on the same plane as that of the lock protrusion 206 or the through-hole 218, or may be on a plane different therefrom.

Figure 4:
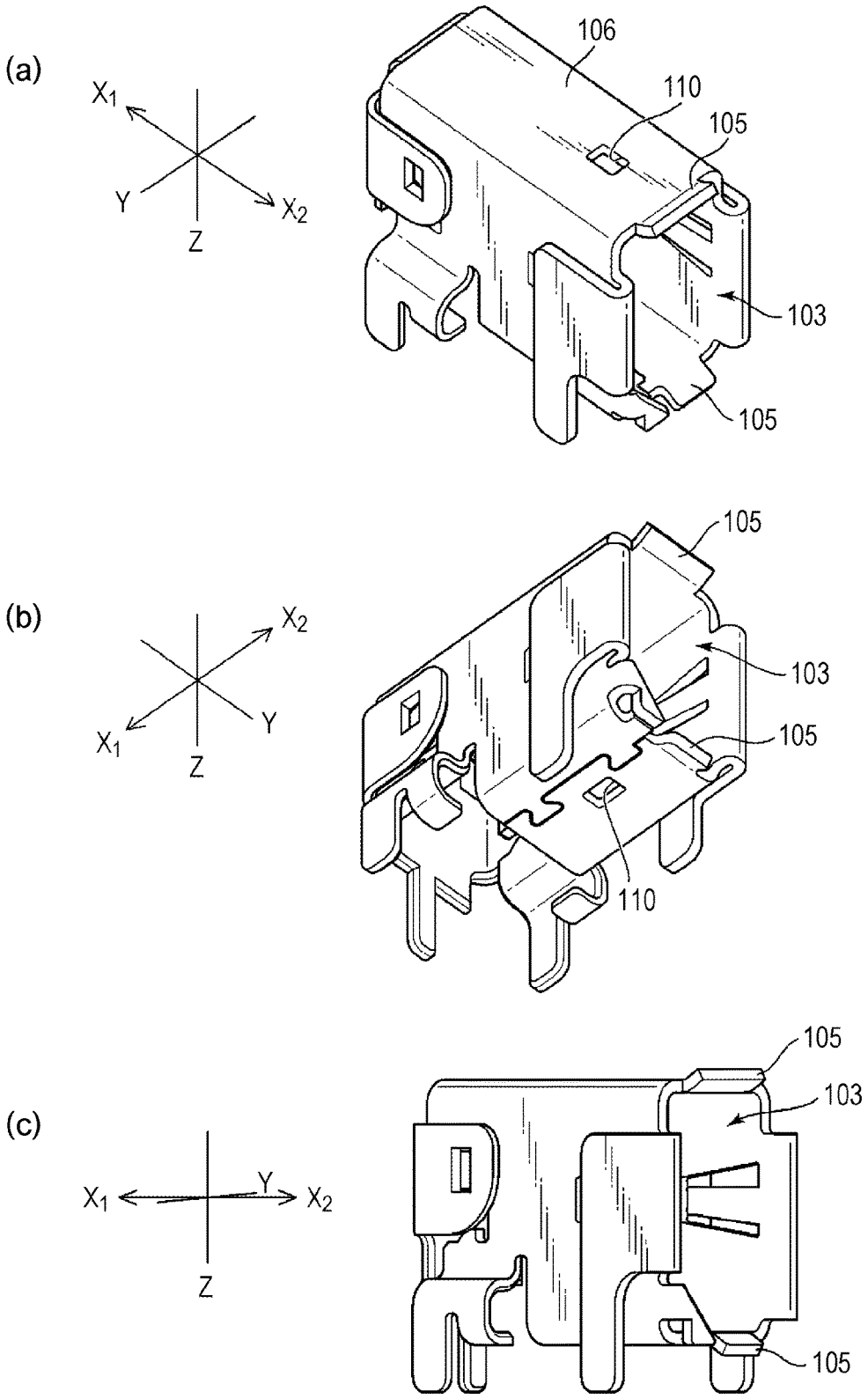
FIG. 4 illustrates views of components of an outer conductor shell of the substrate-side connector.

FIG. 4 illustrates components of the outer conductor shell of the substrate-side connector. FIG. 4(*a*) is a perspective view of the outer conductor shell 106 viewed diagonally from above the tip end side (the X2 side) of the connector, FIG. 4(*b*) is a perspective view of the outer conductor shell 106 viewed diagonally from below the tip end side (the X2 side) of the connector, and FIG. 4(*c*) is a perspective view of the outer conductor shell 106 viewed diagonally from the lateral direction of the tip end side (the X2 side) of the connector. The fitting raised portion 104 formed by the insulator housed inside can be exposed through a shell opening 103 of the outer conductor shell 106, and the space between the fitting raised portion 104 and the inner wall of the outer conductor shell 106 can be formed as the fitting recessed portion 102.

An inclined edge portion 105 extending from an edge portion of the shell opening 103 of the outer conductor shell 106, i.e., an edge portion of the fitting recessed portion 102 (see FIG. 1), and inclined outward can be provided at such an edge portion. The inclined edge portion 105 can be provided at an edge portion which can contact the inclined portion 212 of the cable-side connector 200.

As illustrated in FIGS. 4(*a*) and 4(*b*), the lock holes 110 as the partner engagement portions to be engaged with the lock protrusions 206 as the engagement portions of the cable-side connector 200 are provided on the upper and lower (the upper and lower in the Z-axis direction) of the outer conductor shell 106. The lock hole 110 is provided at single side wall of the outer conductor shell 106, and can be also provided at the side wall opposite to the single side wall.

Figure 5:
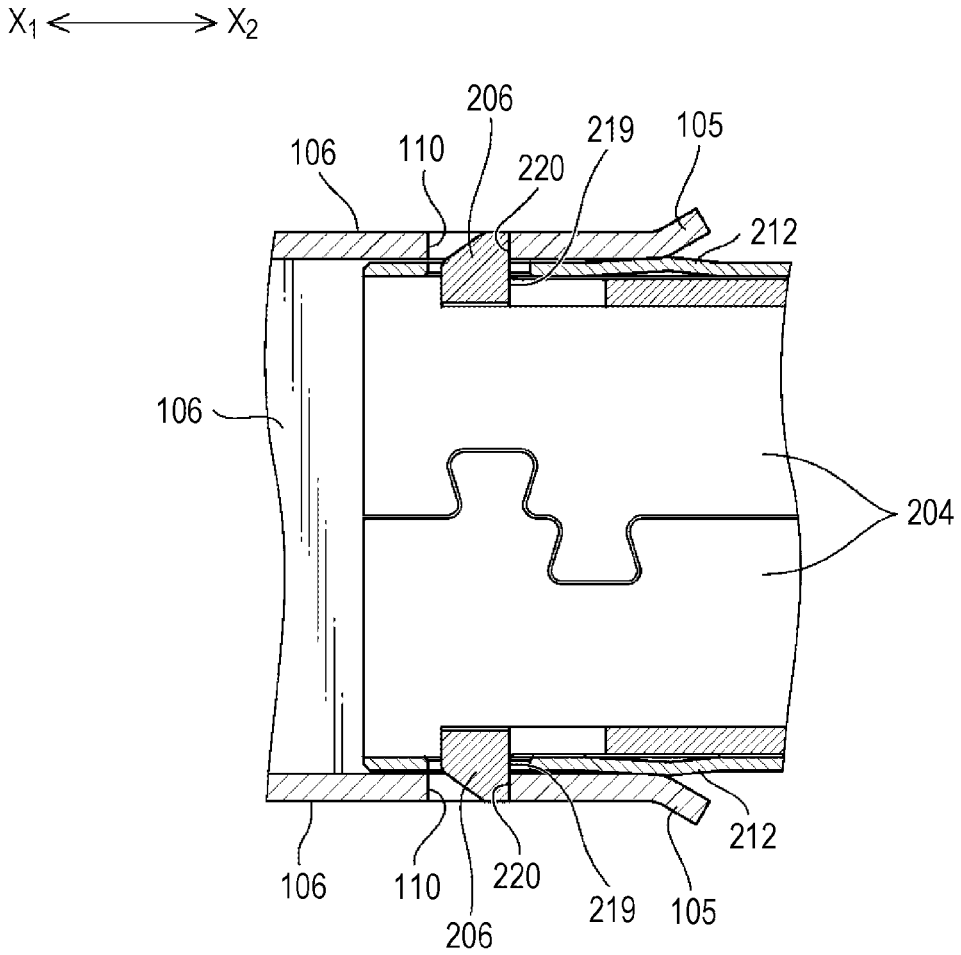
FIG. 5 illustrates, in a state in which the connector according to one embodiment of the present invention is connected to the partner connector, a sectional view of these connectors along a direction perpendicular to a fitting direction.

FIG. 5 illustrates, in a state in which the connector according to one embodiment of the present invention is connected to the partner connector, a sectional view of these connectors along a direction (the Z-axis direction) perpendicular to the fitting direction (the X-axis direction). The lock protrusions 206 of the cable-side connector 200 are fitted in the lock holes 110 of the connector 100 as the partner connector so that a connector connection state can be maintained. A tip end side (X1 side) of the inclined surface of the inclined portion 212 contacts the edge portions of the fitting recessed portion 102 of the partner connector. Such an edge portion is pressed by elastic force of the inclined portion 212, and accordingly, an outer wall of the lock protrusion (the engagement portion) is pressed against an inner wall of the lock hole 110 (the partner engagement portion). Thus, no clearance can be formed between the engagement portions.

In the embodiment illustrated in FIG. 5, the tip end side (X1 side) of the inclined surface of the inclined portion 212 contacts the inclined edge portions 105. The connector 200 is pushed back (the X2 direction) by the elastic force of the inclined portion 212. Accordingly, a back wall 219 of each lock protrusion 206 on the back side (the X2 side) closely contacts the lock contact surfaces 220. This can suppress an engagement clearance, and can suppress backlash. As a result, lowering of high-frequency characteristics due to backlash can be suppressed in advance.

Moreover, the connector 200 is configured such that the inclined portions 212 raised from the side walls of the outer conductor shell 204 are merely provided at the positions contacting the edge portions of the fitting recessed portion 102 of the partner connector (the connector 100). Thus, as compared to a typical connector configured such that a spring piece is provided at the back wall of a fitting recessed portion, the structures of the connector 200 and the connector 100 can be simplified.

INDUSTRIAL APPLICABILITY

The connector according to the present invention can be utilized when devices are connected via a cable for transferring a high-frequency electric signal by an electronic device such as a measurement device configured to handle a high-frequency signal.

DESCRIPTION OF REFERENCE SIGNS

100 Connector
102 Fitting recessed portion
103 Shell opening
104 Fitting raised portion
105 Inclined edge portion
106 Outer conductor shell
108 Shell mounting portion
110 Lock hole
112 Insulator
120 Terminal group
122 Terminal mounting portion
124 Contact portion
126 Bent portion
128 Bent portion
130 Bent portion
132 Terminal mounting portion
200 Connector
202 Fitting portion
204 Outer conductor shell
206 Lock protrusion
208 Lock operation button
210 Cover member
212 Inclined portion
213 Slit
214 Insertion port
216 Shell opening
218 Through-hole
219 Back wall
220 Lock contact surface
300 Substrate
400 Cable

The invention claimed is:

1. A cable-side connector comprising:

an outer conductor shell; and an insulator housed in the outer conductor shell with the insulator holding multiple terminals, wherein the outer conductor shell includes an inclined portion having elasticity in such an inclined shape that a side wall is raised, an engagement portion to be engaged with a partner engagement portion of a partner connector, and a fitting portion to be fitted in a fitting recessed portion of the partner connector, the inclined portion is provided at the side wall of the outer conductor shell which is to contact part of the fitting recessed portion of the partner connector, when the inclined portion contacts the part of the fitting recessed portion, the engagement portion closely contacts the partner engagement portion with no clearance, and the inclined portion is provided at a back position of a position of the engagement portion in a fitting direction in which the fitting portion is to be fitted in the fitting recessed portion of the partner connector.

2. The connector according to claim 1, wherein the inclined portion is provided at a single side wall of the outer conductor shell, and is also provided at a side wall opposite to the side wall.

3. The connector according to claim 1, wherein the inclined portion is provided on a plane same as that of a side wall provided with the engagement portion.

4. The connector according to claim 1, wherein the inclined portion is provided on a plane different from that of the side wall provided with the engagement portion.

5. The connector according to claim 1, further comprising:

a cover member configured to cover a connection portion between the outer conductor shell and a cable, the fitting portion being exposed from a tip end side of the connector; and a lock operation button coupled to the engagement portion and exposed through a hole provided at the cover member, wherein the engagement portion is pushed inward of the outer conductor shell in association with pushing in of the lock operation button.

6. The partner connector to be connected to the connector according to claim 1, comprising:

an outer conductor shell having the partner engagement portion at a position engageable with the engagement portion of the connector; and an insulator housed in the outer conductor shell, wherein the outer conductor shell of the partner connector includes the fitting recessed portion to be fitted onto the fitting portion of the connector, and upon connection with the connector, part of the fitting recessed portion contacts the inclined portion of the connector.

7. The partner connector according to claim 6, wherein upon connection with the connector, the partner engagement portion of the partner connector engages with the engagement portion of the connector, and part of the fitting recessed portion of the partner connector contacts the inclined portion of the connector and is pushed by elastic force of the inclined portion such that no clearance is formed between the partner engagement portion and the engagement portion.

8. The partner connector according to claim 6, wherein a part of the fitting recessed portion which is to contact the inclined portion is an edge portion of the fitting recessed portion, and an inclined edge portion extending from the edge portion and inclined outward is provided.

9. A connector comprising a cable-side connector and a partner connector to be connected to the cable-side connector, wherein the cable-side connector comprises:

a cable-side outer conductor shell; and a cable-side insulator housed in the cable-side outer conductor shell with the cable-side insulator holding multiple terminals, the partner connector comprises:

a partner outer conductor shell having a partner engagement portion and an inclined edge portion extending from an edge portion of the partner outer conductor shell, the inclined edge portion being inclined outward; and a partner insulator housed in the partner outer conductor shell and including a fitting recessed portion, the cable-side outer conductor shell includes:

an inclined portion having elasticity in such an inclined shape that a side wall is raised;

an engagement portion to be engaged with the partner engagement portion of the partner connector; and a fitting portion to be fitted in the fitting recessed portion of the partner connector, the inclined portion comprises an inclined surface at a tip end side of the cable-side outer conductor shell, and the inclined surface contacts the inclined edge portion of the partner outer conductor shell such that an elastic force of the inclined portion pushes back the cable-side connector and a back wall of the engagement portion on a back side closely contacts a lock contact surface of the partner engagement portion.

10. The connector according to claim 9, wherein the inclined portion is provided at a single side wall of the cable-side outer conductor shell, and is also provided at a side wall opposite to the side wall.

11. The connector according to claim 9, wherein the inclined portion is provided on a plane same as that of a side wall provided with the engagement portion.

12. The connector according to claim 9, wherein the inclined portion is provided on a plane different from that of the side wall provided with the engagement portion.

13. The connector according to claim 9, wherein the cable-side connector further comprises:

a cover member configured to cover a connection portion between the cable-side outer conductor shell and a cable, the fitting portion being exposed from a tip end side of the cable-side connector; and a lock operation button coupled to the engagement portion and exposed through a hole provided at the cover member, wherein the engagement portion is pushed inward of the cable-side outer conductor shell in association with pushing in of the lock operation button.

* * * * *